US006965311B1

(12) United States Patent
Karner

(10) Patent No.: US 6,965,311 B1
(45) Date of Patent: Nov. 15, 2005

(54) MEDICAL ALERT MAT WITH REMOTER PAGER

(76) Inventor: Franklin Charles Karner, 12432 Elizabeth Cove, Midwest City, OK (US) 73130

( * ) Notice: Subject to any disclaimer, the term of this patent is extended or adjusted under 35 U.S.C. 154(b) by 170 days.

(21) Appl. No.: 10/716,733

(22) Filed: Nov. 19, 2003

Related U.S. Application Data

(60) Provisional application No. 60/428,499, filed on Nov. 25, 2002.

(51) Int. Cl.[7] ..... G08B 1/08; G08B 21/00

(52) U.S. Cl. ..... 340/539.12; 340/539.1; 340/590; 340/665; 340/666; 200/85 R

(58) Field of Search ..... 340/539.12, 539.1, 340/590, 665, 661, 667, 7.1, 7.2, 666; 200/85 A, 85 R

(56) References Cited

U.S. PATENT DOCUMENTS

| | | | | |
|---|---|---|---|---|
| 3,991,415 A | | 11/1976 | Baar, Sr. | |
| 4,020,482 A | | 4/1977 | Feldl | |
| 4,523,193 A | | 6/1985 | Levinson | |
| 4,924,214 A | * | 5/1990 | Hill | 340/666 |
| 5,757,305 A | | 5/1998 | Xydis | |
| 6,049,281 A | | 4/2000 | Osterweil | |
| 6,160,478 A | | 12/2000 | Jacobsen | |
| 6,166,644 A | | 12/2000 | Stroda | |
| 6,414,589 B1 | | 7/2002 | Angott | |
| 6,434,779 B1 | | 8/2002 | Bartlett | |
| 6,583,727 B2 | | 6/2003 | Nunome | |
| 6,707,386 B1 | * | 3/2004 | Pruisner | 340/665 |

* cited by examiner

*Primary Examiner*—Donnie L. Crosland
(74) *Attorney, Agent, or Firm*—Randal D. Homburg

(57) ABSTRACT

The medical alert mat and the accompanying pager unit is a device utilized primarily for those providing primary care for patients or loved one requiring continual supervision and assistance who are bedridden or medicated to the point where the patient or loved one requires assistance to perform tasks outside of the bed confinement, including toilet access, walking to a chair or general movement, the device having a mat on the floor in a chosen location, the mat having contact plates activated by any pressure on the surface of the mat, sending a wireless signal to a base unit plugged into any 120 volt AC outlet, the base unit having a receiving source activating an audible alarm within a connected or disconnected paging unit sounding the audible alarm when pressure has been applied to the mat. This device may also be used in front of the door of a child's room to indicate the child departure from their room and also serve as a portable security system to detect intruders either at home or during travel.

4 Claims, 3 Drawing Sheets

MEDICAL ALERT MAT WITH REMOTER PAGER

CROSS REFERENCE TO RELATED APPLICATIONS

Provisional Patent Application filed Nov. 25, 2002, Ser. No. 60/428,499.

I. BACKGROUND OF THE INVENTION

1. Field of the Invention

The medical alert mat and the accompanying pager unit is a device utilized primarily for those providing primary care for patients or loved one requiring continual supervision and assistance who are bedridden or medicated to the point where the patient or loved one requires assistance to perform tasks outside of the bed confinement, including toilet access, walking to a chair or general movement, the device having a mat on the floor in a chosen location, the mat having contact plates activated by any pressure on the surface of the mat, sending a wireless signal to a base unit plugged into any 120 volt AC outlet, the base unit having a receiving source activating an audible alarm within a connected or disconnected paging unit sounding the audible alarm when pressure has been applied to the mat. This device may also be used in front of the door of a child's room to indicate the child departure from their room and also serve as a portable security system to detect intruders either at home or during travel.

2. Description of Prior Art

There are several patents which concern remote signaling devices which utilize wireless transmission means, but not as related to the present device, nor do the component parts of the prior art inventions lead one to the elements and interaction of the present invention.

Three monitoring devices are disclosed in prior art, used primarily for monitoring patient activity in a bed. In U.S. Pat. No. 4,020,482 to Feldl, a simple compression bag is placed under a mattress which relays a reduction in pressure through a wire connection to a remote monitoring station. U.S. Pat. No. 6,166,644 to Stroda includes a first monitoring sensor attached to a patient's clothing and a second monitoring system placed under the patient, connected by wires to a remote sending unit, which transmits a signal to a remote station alarm at a nursing station. In U.S. Pat. No. 6,583,727 to Nunome, a pressure sensory matrix of bags is placed upon a mattress upon which a patient is placed, the sensor matrix detecting the position of the patient and relaying this static information to a remote receiving unit. All three of these involve monitoring bedridden patients or patients while in a wheel chair.

A remote patient monitoring device measuring acceleration of movement of a patient is described in U.S. Pat. No. 6,160,478 to Jacobsen, which is directly attached to a patient and monitors the movement of the patient. U.S. Pat. No. 6,049,281 to Osterweil uses an image capturing device to monitor the status of a person in a bed or other area which monitors excessive movement in the area.

In U.S. Pat. No. 6,414,589 to Angott, U.S., Pat. No. 5,757,305 to Xydis and U.S. Pat. No. 4,523,193 to Levinson, remote activated door bell mechanisms are disclosed, which transmit a wireless signal to a remote alert mechanism, all activated by pushing on a button. U.S. Pat. No. 6,434,779 to Bartlett is a segmented doormat. U.S. Pat. No. 3,991,415 to Baar, Sr., includes a doormat which causes a light and a bell to activate when someone steps onto the door mat, forcing a plurality of contact points through a rubber pad to engage a metal plate, closing an electrical circuit. No remote system is used, and a plurality of step-down transformers are required in this hard-wired circuitry.

None of these prior art patents include a self-contained door mat which sends an audible signal when pressure is applied through a signal generated by the contact of two charged plates, sending a remote signal to either a plug-in module or a remote paging unit.

II. SUMMARY OF THE INVENTION

The medical alert mat with remote pager has as its primary objective to serve as a non-visual alert device to detect the presence of pressure on the mat, focused primarily on relieving a caregiver of a critical or bed-bound patient from having to maintain visual contact with the patient in the event the patient tries to leave their bed and ambulate without assistance. When caring for such type patient, often the patient is unaware that their abilities are impaired and that they are quite prone to fall or otherwise hurt themselves if trying to ambulate without assistance. They can forget or become disoriented, or in the event of heavy medication or dementia, fail to remember that they are impaired. This device serves to alert the caregiver that the patient has touched the floor without having to be visually alerted, giving the caregiver the ability to move about the house freely to perform other tasks, the base unit adapted to plug into and operate by wireless transmission signal from any room in the house, and , using the remote paging unit, even go outdoors a short distance.

A second objective is to provide the device for use with small children who leave their rooms, especially at night, to alert a parent that their child has stepped on the mat when crossing a threshold of the door to their room where the mat may be placed.

A third objective provides the device for use when traveling or at home as a security alert device, placed at any location where ingress or egress detection is desired, the mat emitting the signal to the base unit and remote pager when someone touches the mat.

III. DESCRIPTION OF THE DRAWINGS

The following drawings are informal drawings submitted with this provisional patent application.

IV. DESCRIPTION OF THE PREFERRED EMBODIMENT

Figure 1:
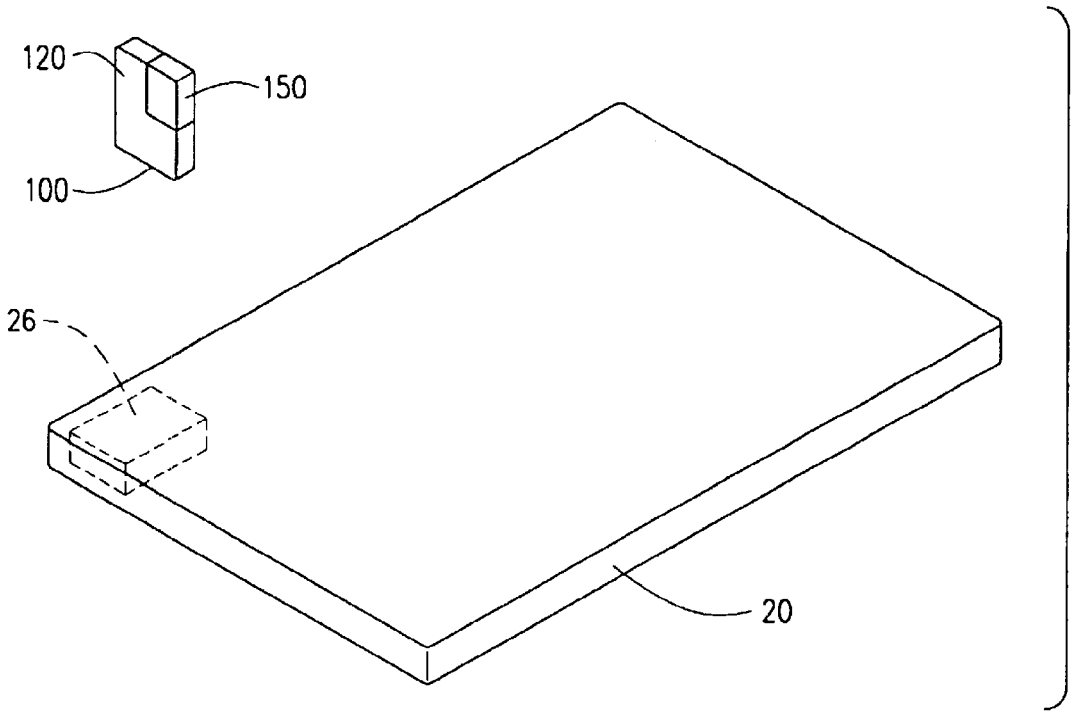
FIG. 1 is a drawing of the medical alert mat and the remote pager unit.

An alert mat and remote pager unit, shown in FIGS. 1–6 of the drawings, comprise a remote pager unit 100 and a low profile flat mat 20 comprising a mat base 22 and a mat upper surface 24 between which is placed a first plurality of metal contact plates 30 in parallel alignment connected by a first low voltage wiring 32 to a positive terminal 52 of a DC power supply 50 and a second plurality of metal contact plates 40 in parallel alignment connected by a second low voltage wiring 42 to a negative terminal 54 of the DC power supply 50. The first plurality of metal contact plates 30 are positioned above and perpendicular to the second plurality of metal plates 40, shown in FIG. 3, the first plurality and second plurality of metal plates 30, 40 having a non-conducting space placed between the first plurality and second plurality of metal plates allowing the first and second plurality of metal plates to remain apart, yet come in contact when light pressure is applied.

Figure 2:
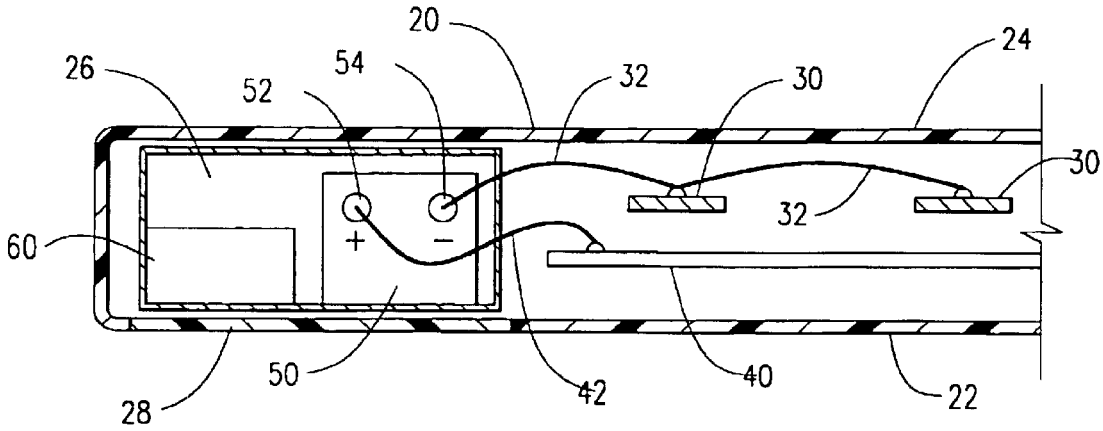
FIG. 2 is a cross section of the medical alert mat showing the DC power supply and the remote send means.
Figure 3:
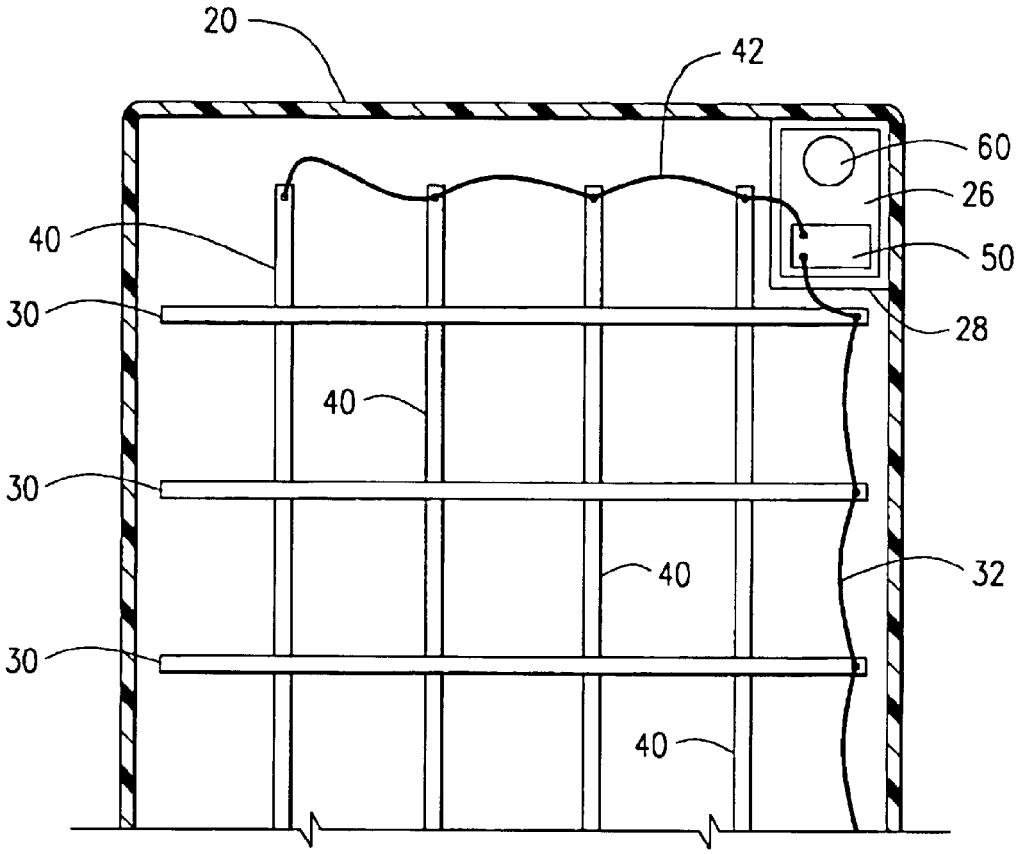
FIG. 3 is a top cut-away view of the medical alert mat.
Figure 4:
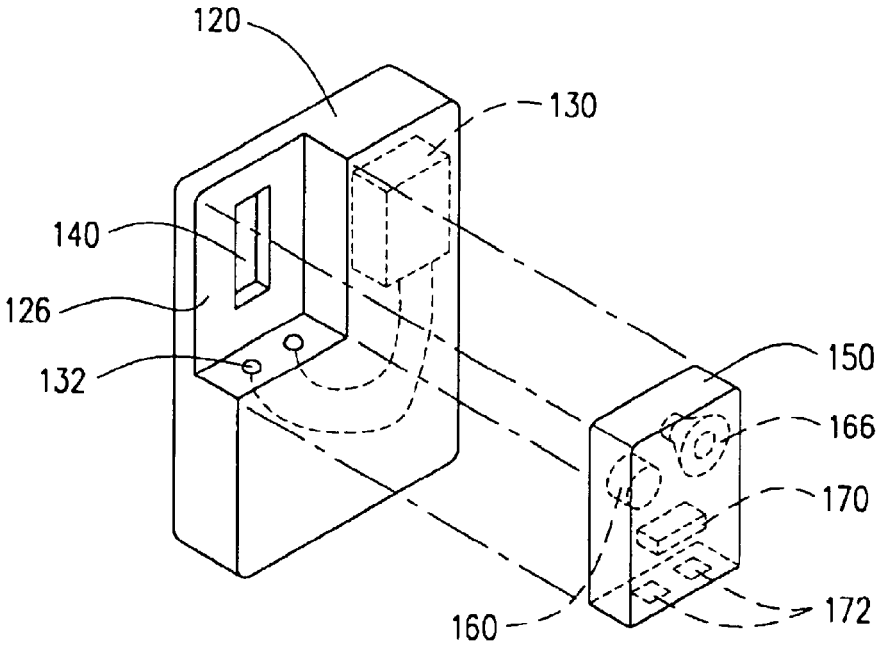
FIG. 4 is a front perspective and expanded view of the base unit of the remote pager unit.

The DC power supply 50 is located in a cavity 26 within the low profile mat 20, shown in FIG. 2, the cavity 26 having an access panel 28 to replace the DC power supply 50 when spent. A wireless remote signal sending means 60 is connected to the first plurality and second plurality of metal plates 30, 40, the remote signal sending means 60 activated when any of the first plurality of metal plates 30 make contact with any of the second plurality of metal plates 40, causing the remote signal sending means 60 to emit a wireless signal of a selected frequency.

Figure 5:
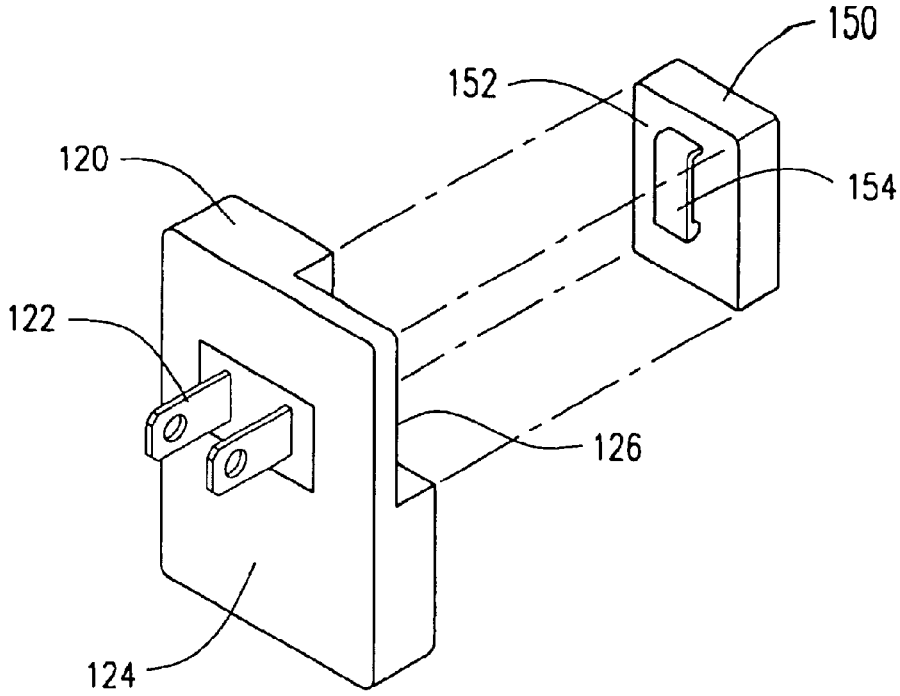
FIG. 5 is a rear perspective and expanded view of the base unit of the remote pager unit.

The remote pager unit 100 comprises a base unit 120 and a remote unit 150, the base unit 120 having a 120 volt AC outlet plug 122 located on a rear surface 124 supplying 120 volt AC current to the base unit 120, as indicated in FIG. 5. This base unit 120 may be plugged into any 120 volt AC household outlet within the vicinity of the mat 20. Connected to the 120 volt AC outlet plug 122 is an AC/ DC converter 130 to convert the AC power to low voltage DC power, the AC/DC converter 130 further connected to a DC charging recess 126 having charging contacts 132, the DC charging recess 126 having a removable retaining means 140 to hold the remote unit 150 within the DC charging recess 126.

The remote unit 150 has a remote signal receiving means 160 connected to a 12 volt rechargeable DC power supply 170, the remote signal receiving means 160 programmed to receive the wireless signal of the selected frequency from the remote signal sending means 60 in the mat 20, activating an audible alarm 166 when the transmitted wireless signal is received by the remote signal receiving means 160. The 12 volt rechargeable DC power supply 170 is connected to recharging terminals 172 located on an exterior 152 of the remote unit 150, the charging terminals 172 positioned to make contact with the charging contacts 132 in the DC charging recess 126 when the remote unit 150 is placed within the DC charging recess 126. The 12 volt rechargeable DC power supply 170 of the remote unit 150 is recharged when attached within the base unit 100. A preferred distance of transmittal of wireless signal of a selected frequency should be no less than 300 feet for optimal efficiency.

The remote unit 150 may also have a clip 154 attached to the exterior 152 to enable the remote unit 150 to be attached to a belt or article of clothing for hands-free carrying. The remote signal receiving means 160 of the remote unit 150 and the remote signal sending means 60 of the mat 20 may be adjustable in frequency, providing a selection of frequency of the wireless signal between the mat and the remote unit, so that the users of the device may select a frequency that would not have interference from other wireless transmitters in a vicinity, which is a common problem identified in other wireless transmission devices. This also allows for use of multiple mats 20 with a single remote unit 150 in the event that a plurality of mats is desired, which might be the case if the device is used as a security means.

Figure 6:
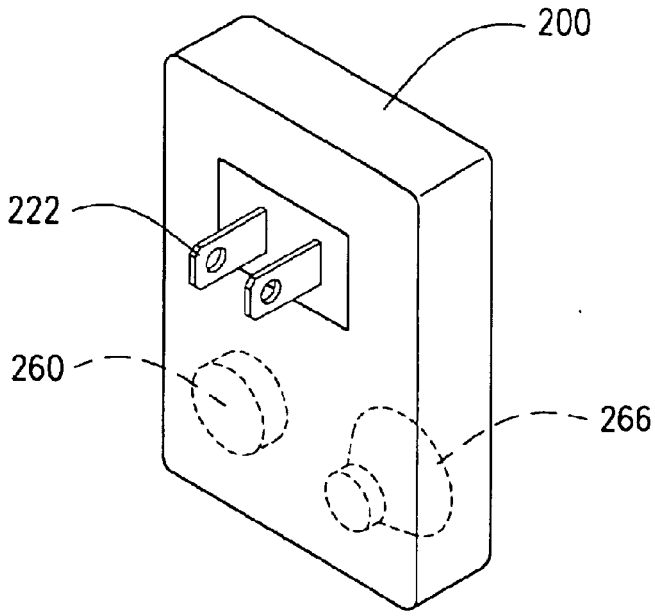
FIG. 6 is an alternative embodiment of the remote unit and base unit incorporated into a singular receiving unit.

In an alternative embodiment, the remote unit and base unit may be incorporated into a singular receiving unit 200 that includes a remote signal receiving means 260 within the singular receiving unit, shown in FIG. 6 of the drawings, which also plugs into any AC plug and also includes the audible alarm 266, the remote signal receiving means 260 and the AC outlet plug 222, the AC outlet plug supplying the sole power to the remote signal receiving means 260 and the audible alarm 266 . This unit would not include the rechargeable DC power supply, the charging terminals, the charging contacts or the DC charging recess.

The size and shape of the mat is not significant and therefore the shape of the mat may be square, rectangular round or other geometric shape, although the mat should be of a sufficient size to cover the desired egress area or a side of a bed where a person would most likely touch when leaving the confines of the bed. The material used in the mat are not significant or specified, but a water-proof material is desired since the mat contains metal contact plates, the DC power supply, low voltage electrical wiring and the wireless signal sending means which might corrode or result in an electrical short if exposed to moisture.

Although the embodiments of the invention have been described and shown above, it will be appreciated by those skilled in the art that numerous modifications may be made therein without departing from the scope of the invention as herein described.

I claim:

1. A remote pager unit and alert mat device placed on a floor of an area to monitor the presence of a person on the medical alert mat, the remote page unit and medical alert mat device comprising:

a low profile mate having a mat base and a mat upper surface;

a first plurality of metal contact plates in parallel alignment connected together by a first low voltage wiring to a positive terminal of a DC power supply between said mat base and said mat upper surface;

a second plurality of metal contact plates in parallel alignment connected together by a second low voltage wiring to a negative terminal of said DC power supply between said mat base and said mat upper surface, said first plurality of metal contact plates positioned above and perpendicular to said second plurality of metal contact plates with a non-conductive space between said first plurality of metal contact plates and said second plurality of metal contact plates which may come into contact when light pressure is applied to said first plurality of metal contact plates;

a cavity containing said DC power supply and a wireless remote signal sending means producing a wireless signal when any of said first plurality of metal contact plates making contact with any of said second plurality of metal contact plates, said cavity having an access panel;

a remote pager unit including a base unit having a 120 volt AC outlet plug located on a rear surface, an AC/DC converter connected to a DC charging recess having charging contacts, said charging recess having a removable retaining means; and said remote pager unit further comprising a remote unit having a remote signal receiving means connected to a 12 volt rechargeable DC power supply, said remote signal receiving means receiving the wireless signal produced by the wireless remote signal sending means activating an audible alarm, said rechargeable DC power supply connected to charging terminals located on an exterior of said remote pager unit, said charging terminals making contact with said charging contacts in said DC charging recess when said remote pager unit is engaged within said charging recess, said remote paging unit also having a clip on said exterior allowing for said remote paging unit to attach to an article of clothing.

2. The remote pager and alert mat device as disclosed in claim 1, wherein said remote signal receiving means of said remote unit and said remote signal sending means of said mat provide an adjustable frequency of the wireless signal between said mat and said remote unit, allowing for use of multiple mats with a single remote unit in the event that a plurality of mats is used for a security purpose.

3. A remote pager unit and medical alert mat device placed on a floor of an area to monitor the presence of a person on the medical alert mat, the remote page unit and medical alert mat device comprising:

a low profile mate having a mat base and a mat upper surface;

first plurality of metal contact plates in parallel alignment connected together by a first low voltage wiring to a positive terminal of a DC power supply between said mat base and said mat upper surface;

a second plurality of metal contact plates in parallel alignment connected together by a second low voltage wiring to a negative terminal of said DC power supply between said mat base and said mat upper surface, said first plurality of metal contact plates positioned above and perpendicular to said second plurality of metal contact plates with a non-conductive space between said first plurality of metal contact plates and said second plurality of metal contact plates which may come into contact when light pressure is applied to said first plurality of metal contact plates;

a cavity containing said DC power supply and a wireless remote signal sending means producing a wireless signal when any of said first plurality of metal contact plates making contact with any of said second plurality of metal contact plates, said cavity having an access panel;

a singular receiving unit including a remote signal receiving means receiving the wireless signal produced by the wireless remote signal sending means activating an audible alarm, and an AC outlet plug adapted to be plugged into any AC outlet plug.

4. The remote pager and alert mat device as disclosed in claim 3, wherein said remote signal receiving means of said singular receiving unit and said remote signal sending means of said mat provide an adjustable frequency of the wireless signal between said mat and said singular receiving unit, allowing for use of multiple mats with said singular receiving unit in the event that a plurality of mats is used for a security purpose.

* * * * *